US006588961B2

(12) United States Patent
Lafosse-Marin et al.

(10) Patent No.: US 6,588,961 B2
(45) Date of Patent: Jul. 8, 2003

(54) SEMI-ENCLOSED APPLICATOR FOR DISTRIBUTING A SUBSTANCE ONTO A TARGET SURFACE

(75) Inventors: Isabelle Lafosse-Marin, West Chester, OH (US); Carl Phillip Haney, Lutherville, MD (US); Pedro Miguel Mendoza, Miranda (VE)

(73) Assignee: The Procter & Gamble Company, Cincinnati, OH (US)

( * ) Notice: Subject to any disclaimer, the term of this patent is extended or adjusted under 35 U.S.C. 154(b) by 25 days.

(21) Appl. No.: 09/793,161

(22) Filed: Feb. 26, 2001

(65) Prior Publication Data

US 2002/0118993 A1 Aug. 29, 2002

(51) Int. Cl.[7] ..... B43K 5/14

(52) U.S. Cl. ..... 401/134; 401/7; 401/132; 401/205

(58) Field of Search ..... 401/201, 132, 401/133, 134, 6, 7, 8, 205; 604/3, 2

(56) References Cited

U.S. PATENT DOCUMENTS

| | | | |
|---|---|---|---|
| 2,790,982 | A | 5/1957 | Schneider |
| 3,485,562 | A | 12/1969 | Hidden et al. |
| 3,768,916 | A | 10/1973 | Avery |
| 3,777,328 | A | 12/1973 | Kaplan |
| 3,806,260 | A | 4/1974 | Miller |
| 3,929,135 | A | 12/1975 | Thompson |
| 3,982,298 | A | 9/1976 | Ota |
| 3,995,766 | A | 12/1976 | Fralick |
| 4,081,256 | A | 3/1978 | Donnelly |
| 4,324,246 | A | 4/1982 | Mullane et al. |
| 4,342,314 | A | 8/1982 | Radel et al. |
| 4,430,013 | A | 2/1984 | Kaufman |
| 4,475,835 | A | 10/1984 | Verboom et al. |
| 4,563,103 | A | 1/1986 | Overloop et al. |
| 4,596,481 | A | 6/1986 | Tanaka |
| 4,600,620 | A | 7/1986 | Lloyd et al. |

(List continued on next page.)

FOREIGN PATENT DOCUMENTS

| | | |
|---|---|---|
| CA | 246890 | 2/1925 |
| CA | 320369 | 3/1932 |
| CA | 380909 | 4/1939 |
| CA | 439821 | 2/1947 |
| CA | 440402 | 3/1947 |
| CA | 456478 | 5/1949 |
| CA | 473561 | 5/1951 |
| CA | 547411 | 10/1957 |
| CA | 673196 | 10/1963 |
| CA | 697143 | 11/1964 |
| CA | 2030152 | 4/1992 |
| CH | 303374 | 2/1955 |
| DE | 354592 | 6/1922 |
| EP | 291284 | 11/1988 |
| EP | 294189 | 8/1994 |
| FR | 459221 A | 10/1913 |
| FR | 2754744 | 4/1998 |
| WO | PCT/US 00/27970 | 10/2000 |
| WO | WO 01/26527 A1 | 4/2001 |

OTHER PUBLICATIONS

U.S. patent application Ser. No. 08/635,220, Davis et al., filed Apr. 17, 2000.

*Primary Examiner*—David J. Walczak
(74) *Attorney, Agent, or Firm*—Peter D. Meyer

(57) ABSTRACT

A semi-enclosed applicator, such as a mitt, for distributing a substance onto a target surface. The mitt has a first layer, a second layer in face-to-face contact with the first layer, and a third layer in face to face contact with the second layer. The first and second layers are positioned to form a cavity to allow for a product dispensing reservoir to be placed. The first layer, second layer and reservoir are removably attached to the third layer for removal by the user after use.

15 Claims, 9 Drawing Sheets

U.S. PATENT DOCUMENTS

| | | | | |
|---|---|---|---|---|
| D290,777 | S | | 7/1987 | Lee |
| 4,787,775 | A | | 11/1988 | Hammer |
| 4,902,283 | A | | 2/1990 | Rojko et al. |
| 4,931,201 | A | | 6/1990 | Julemont |
| 4,955,747 | A | | 9/1990 | Tarver |
| 4,959,881 | A | | 10/1990 | Murray |
| 4,963,432 | A | | 10/1990 | Fuggini et al. |
| 5,007,754 | A | | 4/1991 | Zierhut |
| 5,010,617 | A | | 4/1991 | Nelson |
| 5,020,930 | A | | 6/1991 | Kuhn |
| D320,311 | S | | 10/1991 | Kuhn |
| 5,090,832 | A | | 2/1992 | Rivera et al. |
| 5,112,152 | A | | 5/1992 | McBride |
| 5,169,251 | A | * | 12/1992 | Davis ..... 401/132 |
| 5,188,472 | A | | 2/1993 | Sgro |
| 5,230,119 | A | | 7/1993 | Woods et al. |
| 5,242,232 | A | | 9/1993 | Kuhn |
| 5,245,025 | A | | 9/1993 | Trokhan et al. |
| 5,324,127 | A | | 6/1994 | Cortez |
| 5,473,789 | A | | 12/1995 | Oster |
| 5,518,801 | A | | 5/1996 | Chappell et al. |
| 5,527,428 | A | | 6/1996 | Trokhan et al. |
| 5,534,326 | A | | 7/1996 | Trokhan et al. |
| 5,568,990 | A | | 10/1996 | McAuley |
| 5,605,749 | A | | 2/1997 | Pike et al. |
| 5,615,440 | A | | 4/1997 | Cowan et al. |
| 5,636,406 | A | | 6/1997 | Strong |
| 5,649,336 | A | | 7/1997 | Finch et al. |
| 5,650,214 | A | | 7/1997 | Anderson et al. |
| 5,654,076 | A | | 8/1997 | Trokhan et al. |
| 5,658,084 | A | | 8/1997 | Wirt |
| 5,738,212 | A | | 4/1998 | Pollard et al. |
| 5,815,840 | A | | 10/1998 | Hamlin |
| 5,820,730 | A | | 10/1998 | Phan et al. |
| 5,829,089 | A | | 11/1998 | Steadman |
| 5,916,661 | A | | 6/1999 | Benson et al. |
| 6,145,155 | A | | 11/2000 | James et al. |
| 6,250,829 | B1 | * | 6/2001 | Brower et al. ..... 401/132 |

* cited by examiner

SEMI-ENCLOSED APPLICATOR FOR DISTRIBUTING A SUBSTANCE ONTO A TARGET SURFACE

FIELD OF THE INVENTION

The present invention relates to a semi-enclosed applicator useful for distributing substances onto target surfaces. The present invention also relates to such an applicator that also contains a substance for application to the surface of a target object. More particularly, the present invention relates to such applicators wherein the substance may be released from the applicator material and distributed upon the surface of the target object. A layer of the applicator is then removed revealing another layer for further treatment of the target surface. Even more particularly, excess substance is removed from the surface and optionally absorbed by the applicator.

BACKGROUND OF THE INVENTION

In the art of dispensing, articles have been developed which are coated or impregnated with useful substances intended to be utilized, activated, or released when the article is contacted with a target surface. While there are advantages with having the substance on or near the surface of such articles, there is often the drawback that the substance is unprotected and is subject to inadvertent contact before intended use. Inadvertent contact may lead to contamination of the substance, loss of the substance onto surfaces other than the desired target surface, and/or contamination of such other surfaces with the substance. Moreover, the use of such articles to manually apply a substance to a surface of an object frequently results in exposure of a user's hands to the substance. At the very least such a scenario results in a waste of product and is undesirable from an aesthetic standpoint and, at worst, results in exposure of the user to potentially harmful, toxic, or otherwise undesirable substances.

Common approaches to dispensing a substance on a target surface involve dispensing a substance such as a polish or protectant from a bottle or other closed vessel onto the target surface, then utilizing a rag, sponge, towel, brush, or other implement to distribute the product on the surface and, if desired, absorb any excess product, potentially with another implement or substrate. Such practices are commonplace with surfaces such as shoes, leather goods, leather coats, handbags, briefcases, belts, plastics, rubber, furniture, cars (inside and outside), and vinyl surfaces. While such practices are widely accepted, they often result in inefficient use of product and/or contact with the substances involved. Moreover, utilizing such an implement typically only provides one type of applicator for use in contacting the substance and the target surface. Applying the substance to the applicator from a vessel at the point of use likewise often results in inefficient use of product and/or contact with the substances involved.

A common approach to polishing leather or other surfaces, for example, is to rub a cleaner or polish onto the surface and then wipe the surface with a clean rag or paper towel. Application of the polish usually wastes some of the polish due to over-application or from excess polish landing on areas not intended to be polished. This over-application is often undesirable due to waste because some surfaces can be harmed, or may require additional surfaces to be cleaned. The rag or paper towel is used to both spread the polish on the surface as well as absorbing any excess. The rag or paper towel has a difficult time spreading the cleaning solution since it is typically designed to be highly absorbent. To compensate, an independent applicator can be used to spread the polish. Then a separate clean rag or dry paper towel can be used to buff the object and absorb any excess polish. Some consumers use newspaper quality paper or low absorbency paper towels. This type of paper has a lower absorbency level and may do a better job of spreading the polish instead of absorbing the polish. Also, this type of paper has a stiffer and harder furnish which may buff the object to a higher degree of shine. However, this approach is less desired because special paper towels are required and a lot of buffing is required to get the desired end result.

With conventional polishing implements, applicators are not ideally suited for cleaning curved or other surfaces with jagged edges, surfaces otherwise requiring protection of the user's hand, or tough to reach areas. Multiple elements are required to perform complementary tasks such as cleaning, polishing, drying, coloring, and/or buffing surfaces, but also because it provides a means of doing the job on tough to reach areas or surfaces. Such a combination of benefits is lacking in present day cleaning systems.

Accordingly, it would be desirable to provide an applicator for applying a substance to a target surface that permits greater control by the user during the application and finishing processes.

It would also be desirable to provide such an applicator that permits the user to apply a substance to a target surface, treat the target surface and provide an increased shine with reduced messiness and waste of the substance.

SUMMARY OF THE INVENTION

A semi-enclosed applicator is provided for the distribution of a substance onto a target surface. The applicator comprises a first layer with a first internal surface and a first external surface and a second layer with a second internal surface and a second external surface. The second internal surface faces the first internal surface of the first layer forming an internal cavity. A third layer faces the second external surface of the second layer. A reservoir is positioned between said first and second layers. The reservoir is dispensible through said first layer and the first and second layers are removably attached to the third layer without an unintended tearing of the applicator.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements, reference numerals with the same final two digits identify corresponding elements, and wherein:

DETAILED DESCRIPTION OF THE INVENTION

Figure 1:
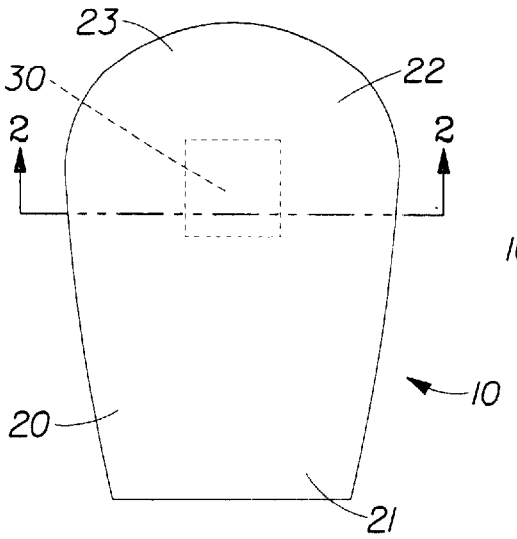
FIG. 1 is a plan view of a preferred embodiment of a semi-enclosed applicator in accordance with the present invention, in the form of a mitt.

As used herein, the term "hand article" refers to a covering for the hand or portion of the hand such as a finger or thumb. The term "disposable" is used herein to describe hand articles that are not intended to be restored or reused (i.e., they are intended to be discarded after a single use or a limited number of uses, and preferably, to be recycled, composted or otherwise disposed of in an environmentally compatible manner). As used herein the term "glove" refers to a covering for the hand having separate sections for each finger. As used herein, the term "mitt" refers to a covering for the hand having an enclosure that leaves some or all of the fingers partially or wholly unseparated and that may include space for the thumb in the main enclosure or may provide space for the thumb in a separate enclosure for the thumb or may not include a thumb enclosure at all. This term is also applicable to an apparatus which covers only one or more digits of a user, such as in the case of a "finger mitt" as described below. While the terms "glove" and "mitt" have been defined with respect to the human hand, similar structures could be utilized to cover or enclose other elements of human anatomy, such as foot coverings, or other items for which coverings of a particular shape are preferred. As used herein, the term "absorb" refers to the penetration of one substance into the mass of another. ASTM standard test method D2654-89a "Standard Test Methods for Moisture in Textiles," herein incorporated by reference, should be used to determine the percentage of a liquid, such as water, absorbed and retained. An absorbent material for the purposes of the present invention has a moisture regain according to the ASTM standard test method D2654-89a of greater than about 5% (e.g., a cellulose acetate fiber having a moisture regain of about 6.5%). A non-absorbent fiber for the purposes of the present invention, however, has a moisture regain of less than about 5% (e.g., a polyester fiber having a moisture regain of about 4%). As used herein the term "substantially non-absorbent" is defined as a material composed of a majority of non-absorbent fibers or webs. As used herein the term "substantially absorbent" is defined as a material composed of a majority of absorbent fibers or webs. As used herein the term "extension force" refers to forces applied by movements to a surface to extend and/or bend that surface linearly and/or curvilinearly. The term "pouch" or "sachet" refers to a reservoir made from flexible film that is bonded to create one or more enclosed compartments for containing a substance.

The term "semi-enclosed applicator" is intended to refer to an applicator device having at least one accessible cavity for receiving a portion of human anatomy, such as a hand or finger, so that the applicator device may be used as an implement. A glove, mitt or finger mitt would be an example of such a semi-enclosed applicator in the context of the present invention.

Applicator Construction and Operation

A representative embodiment of a semi-enclosed applicator of the present invention in the form of a hand article is the disposable mitt 10 shown in FIG. 1. FIG. 1 is a plan view of the mitt 10 of the present invention in its flat-out state illustrating the body portion 20, cuff portion 21, central portion 22, distal portion 23, and reservoir 30. In general terms, the mitt 10 has an internal cavity that is accessible through an opening in the cuff portion and that extends inwardly toward the distal end that is closed.

Figure 2:
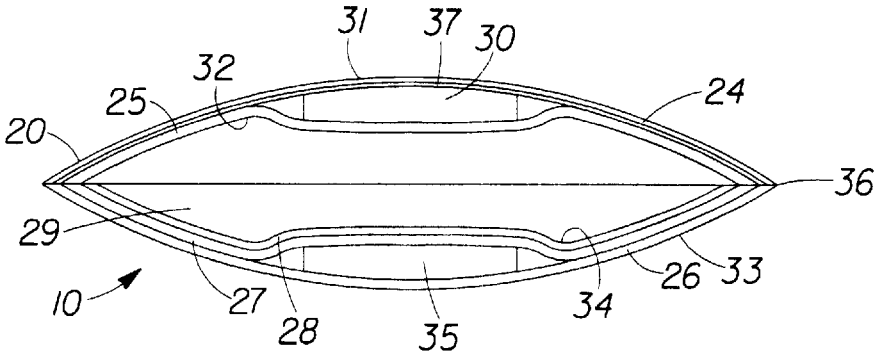
FIG. 2 is a cross-sectional view of the mitt of FIG. 1 taken along line 2—2.

FIG. 2 shows the construction details of the mitt 10 more specifically. The mitt 10 has a front outer surface 31, a front inner surface 32, a back outer surface 33, and a back inner surface 34. The front and back inner surfaces 32 and 34 define a hollow interior 29 into which a hand may be inserted through an opening in the cuff portion 21. The mitt 10 includes a front panel 24, which defines the front outer surface 31, and a back panel 26, which defines the back outer surface 33. The front and back panels are connected along their periphery to form a seam 36. The seam 36 or panels can be straight or may be tapered. For example, the seam 36 may be inwardly tapered in the area of the cuff region to allow the applicator to stay on the hand of the user better. In addition to, or in place of, tapered seams, elastic material may be added in the cuff region to keep the applicator on the hand of the user. Additionally, other adhesives or other mechanical fastener tapes, such as a hook and loop system, can be used to secure the mitt 10 to the user's hand.

A semi-enclosed applicator of the present invention may be constructed for many different uses. Unlike conventional polishing implements, the applicators are ideally suited for cleaning curved or other surfaces with jagged edges, surfaces otherwise requiring protection of the user's hand, or tough to reach areas. As a result, the product form provides convenience not only because it may comprise multiple different surfaces that may perform complementary tasks such as cleaning, polishing, drying, coloring, and/or buffing surfaces, but also because it provides a means of doing the job on tough to reach areas or surfaces. Such a combination of benefits is lacking in present day cleaning systems. The mitts can be stored individually, or placed and stacked in containers, folded or unfolded. As such, they occupy little space and can be stored in small areas, which improves convenience for the users. The combination of easy storage and ability to polish non-uniform surfaces such as shoes, horse saddles, hand-bags, and other polishable goods makes them ideal for use in limited space compartments, where conventionally employed polishing processes are awkward, ineffective and potentially hazardous.

Reservoir

The reservoir 30 contains a product that may be dispensed, expressed, released, and/or dispersed from the reservoir 30 to one or more of the outer surfaces of an applicator 10, such as outer surface 31, for delivery to a target surface. The reservoir 30, and optional second reservoir 35, may be of any suitable size, configuration, and composition for the intended product to be dispensed and dispersed. Active formulas and the choice of substrates may be adapted for this wide range of applications. The substance may be a liquid, a gel, a lotion, a cream, a powder or even a solid. A solid substance such as a wax, for example, may be heated to provide a flowable product that may be dispensed and/or dispersed from the reservoir 30.

In one embodiment, the reservoir 30, can improve the overall functionality of the mitt 10, through a sealed, fully-enclosed reservoir to rupture or otherwise dispense the product contained therein when "activated" by the user and yet resist premature dispensing during manufacture, packaging, and shipment. Rupture may occur by compression against the target surface. In alternative embodiments, the reservoir may be located at least partially outside of the applicator 10. For example, chamber 47 of reservoir 30 of FIG. 6 might extend outwardly from an applicator for improved visual and manual access, as desired. The ability of the reservoir to survive intact until the point of use preserves the quality and quantity of the liquid until the time of use. As will be understood, external accessibility to a reservoir 30 might also facilitate the provision of crimping devices, folding of a reservoir 30 or other protection of the reservoir against premature dispensing, as will be discussed further below. Alternatively, the reservoir 30 may be a separate article that can be inserted into the mitt 10 by the user. For example, the reservoir 30 may be inserted inside of the front panel 24 of the mitt 10 or may be inserted into one or more pockets located between the front outer surface 31 and the front inner surface 32 that are designed to receive the reservoir 30.

In one embodiment, the reservoir can be designed to burst or rupture to release the product contained within the reservoir at a conveniently low compressive force when desired by the consumer. This may be accomplished by having a sealed pouch with permanent seals and also seals that are "frangible", i.e., rupturable. When the pouch is squeezed or otherwise manipulated, the frangible seal will yield or fail first since it has a lower failure point than the permanent seals. In one embodiment, the frangible seal will ideally rupture with 0.4–1.5 Kg of force when applied by the consumer.

Figure 6:
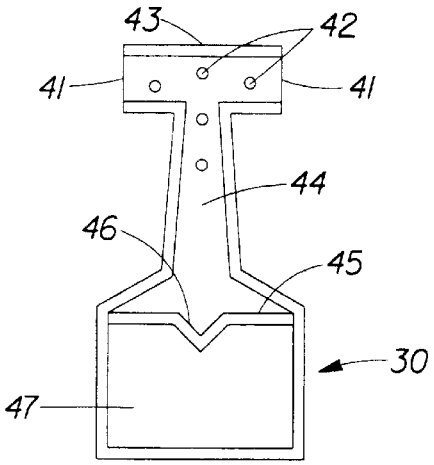
FIG. 6 is a plan view of another embodiment of a rupturable reservoir suitable for use in accordance with the present invention.

Referring to FIG. 6, adding stress concentrators in the seal geometry that will localize forces at a particular location can optimize the location of rupture. These stress concentrators can be shaped like a V, a notch, a half circle or a variety of other shapes depending upon the desired burst level. These stress concentrators will help control the force required to burst the pouch as well as the location of where the seal will rupture. Such stress concentrators thereby focus or concentrate external pressure or mechanical forces imposed on the reservoir and its contents. For example, pressurizing a pouch having a V-notch seal such as shown in FIG. 6 will localize forces first at the apex of the V, causing that region to rupture first. Such an arrangement can help reduce potential variability in rupture or dispensing forces and the location where the rupture occurs. Additionally, other seal angles and geometries of the seal can also be used to tailor dispensing forces for particular applications.

In the embodiment of FIG. 1, the reservoir 30 is positioned in the central portion 22 of the mitt 10. This central location of reservoir 30 allows for an omnidirectional dispensing or application. In this location, the reservoir 30 can be subjected to sufficient force to rupture the reservoir and dispense the fluid by making a fist with the user's hand, by applying force with the opposite hand, or by pressing the palm against the target surface. This location of the reservoir 30 in the applicator is convenient for applications where it is desired for the product to be dispensed all at once or while rubbing a surface. It may also be desired to have the reservoir located in a portion of the applicator that is spaced or remote from a location where forces are applied during cleaning or rubbing. In this manner, pressure applied to the mitt during cleaning or rubbing will not cause premature dispensing or dosing of the product in the reservoir 30.

Figure 3:
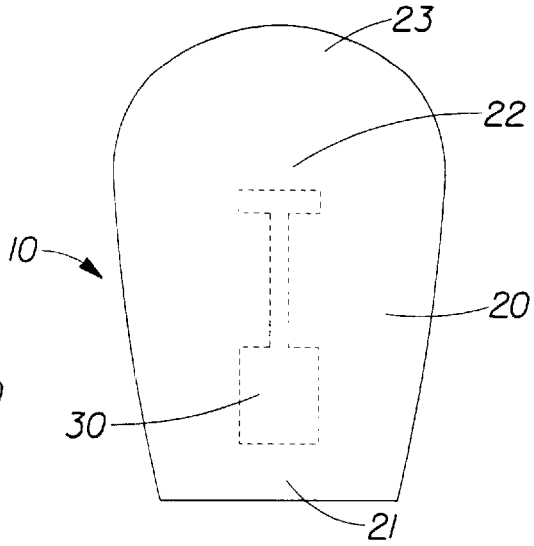
FIG. 3 is a plan view of another embodiment of a semi-enclosed applicator in accordance with the present invention, also in the form of a mitt.

FIG. 3, for example, depicts an alternative embodiment of a mitt 10 wherein the reservoir 30 is positioned closer to the cuff region 21. In this location, the reservoir 30 is not located in a region of the mitt that would typically encounter forces in use (the application or pressure region), and the reservoir 30 would require activation by specifically applying force to the cuff region. Such an embodiment may be particularly advantageous where progressive dispensing of discrete quantities of the product is desired rather than an "all at once" dispensing upon application of an initial force. This is particularly advantageous in keeping the dispensed substance away from the reservoir and keeps the region proximate to the reservoir contaminant-free.

The use of a reservoir to contain a product allows the applicator to become wet on the desired side only when wanted by the person using the applicator. In some cases a person would like to store a single applicator in a limited space storage environment. The hermetically sealed reservoir(s) in the applicator preferably use sufficient barrier materials to allow these individual applicators to have multi-year shelf life even when stored as individual units. In contrast, pre-moistened wet wipes, according to the prior art, that have been individually wrapped are traditionally placed in a foil pouch. This foil pouch material is expensive and more of it is needed to enclose the entire wipe to prevent moisture loss (with the individually enclosed reservoir, foil film is only needed to enclose the liquid or substance). This approach of putting the entire pre-moistened applicator (wipe) in a foil pouch also makes it difficult for the wipe to have a dry surface or from having surfaces with two different substances since cross-contamination is likely to occur.

Figure 4:
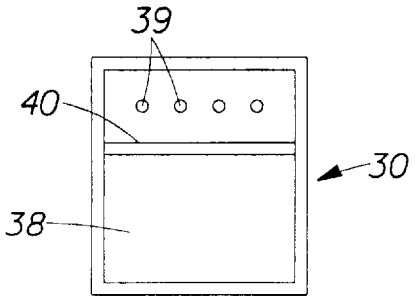
FIG. 4 is a plan view of one embodiment of a rupturable reservoir suitable for use in accordance with the present invention.

FIG. 4 illustrates one suitable configuration for a rupturable reservoir 30 suitable for use with applicators according to the present invention, such as the applicator of FIG. 1. In the embodiment of FIG. 4, the reservoir 30 includes a chamber 38, a frangible seal 40, and at least one dispensing aperture 39. The embodiment of FIG. 4 may be made by peripherally joining two similarly-sized and shaped pieces of fluid-impervious material with substantially permanent seals, forming the dispensing apertures in one portion of at least one of the pieces of material, introducing the product through one of the apertures, and then forming a frangible seal of limited strength to separate the chamber 38 from the apertures 39. Other forming techniques, such as folding a single piece of material double upon itself and sealing, or rolling and sealing a piece of material to form a sleeve, may also be utilized.

Figure 5:
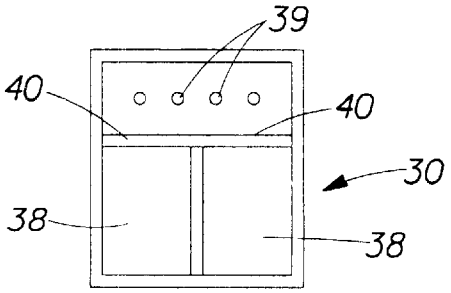
FIG. 5 is a plan view of another embodiment of a rupturable reservoir suitable for use in accordance with the present invention.

FIG. 5 depicts another embodiment of a reservoir 30 that is functionally similar to that of FIG. 4, but including a plurality of chambers 38 for containing liquid. Respective chambers 38 may include product(s) of the same, similar, or diverse compositions, and may be designed to be ruptured sequentially or simultaneously depending on how pressure or squeezing is applied by the user.

More advanced product distribution functionality may be designed into the reservoir and/or to the applicator. The bursting pouch may also have an integral distribution head (such as illustrated as channel 44 of FIG. 6) that allows the product to be dispensed and dosed to different portions of the mitt. This distribution head is ideally an extension of the pouch material that has been sealed in a way to form channels for the product to flow to another region. The distribution head may have holes 41 in the sides or holes 42 on the face for the product to exit or may have several seals that force the product to change direction minimizing the velocity of the product exiting and thus eliminating or reducing uncontrolled release of product out of the mitt. Other arrangements, such as the inclusion of baffling structure to divert or control the fluid might be desirable as well, such as where the delivery product has been exposed to heat, generating a low viscosity.

Figure 14:
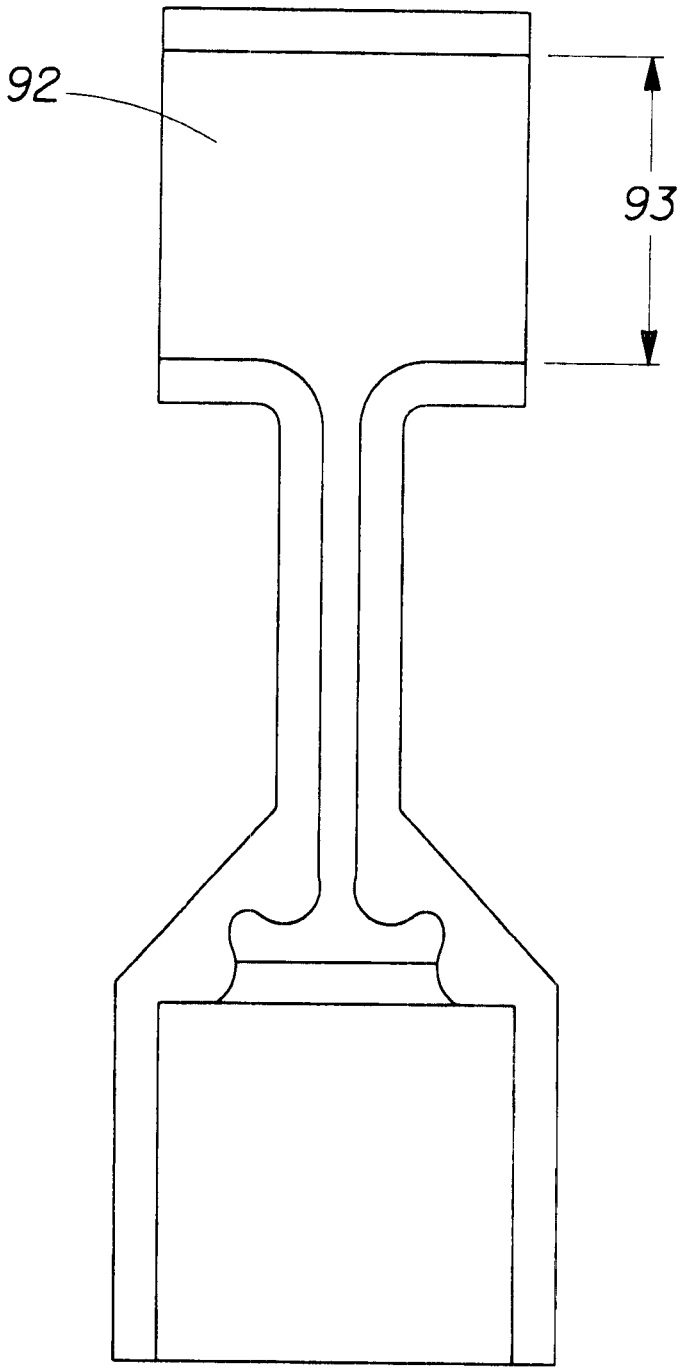
FIG. 14 is a plan view of another embodiment of a rupturable reservoir suitable for use in accordance with the present invention.

FIG. 14 shows one alternative embodiment of a distribution head 92. In this embodiment, the sides are slit the entire length 93 and are thus coupled with the large area allowing product to spread greatly within the head before releasing onto the mitt. Thus, this distribution head embodiment allows product to slowly weep out. The distribution head can be modified greatly to match desired product delivered.

Figure 15:
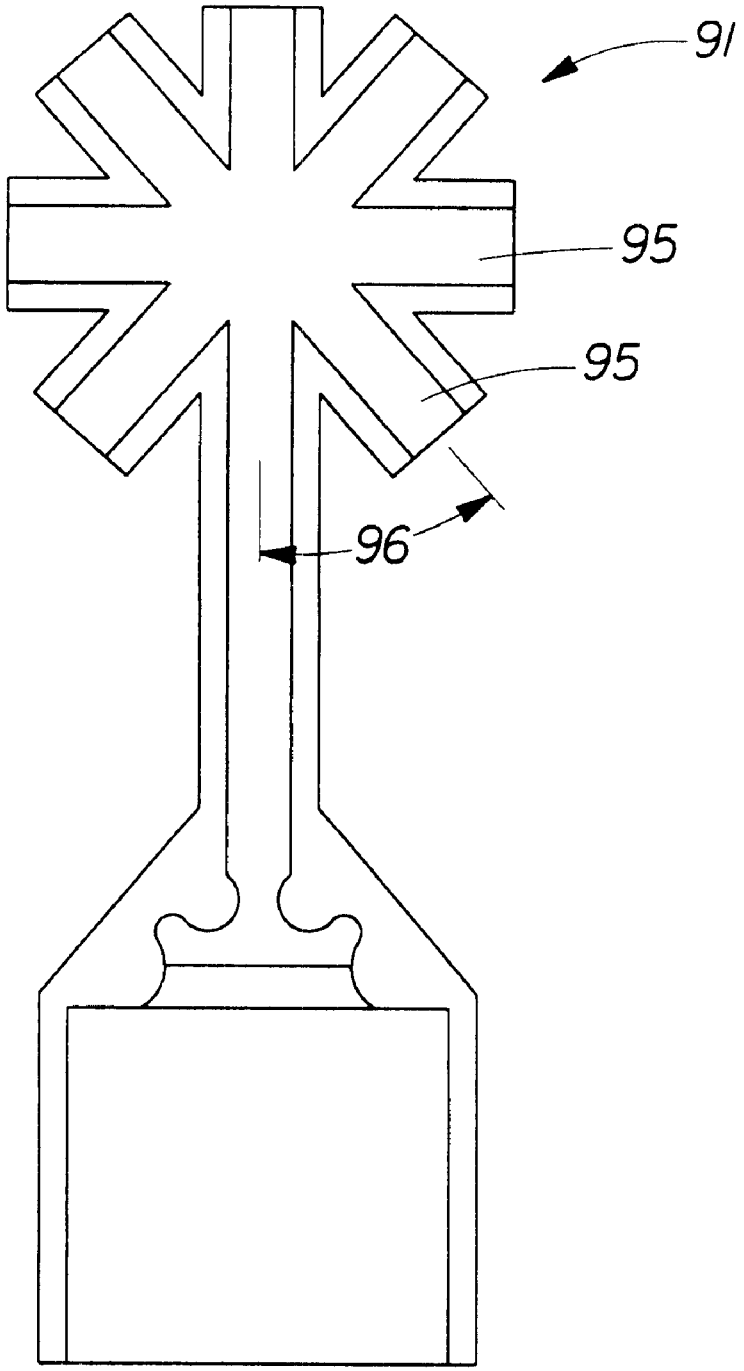
FIG. 15 is a plan view of another embodiment of a rupturable reservoir suitable for use in accordance with the present invention.

FIG. 15, for example, shows several "fingers" 95 protruding from the dosing head 91 thus allowing product to be delivered directly to various locations. The number of fingers 95, the angle 96 with respect to the dosing head 91, and the length of each finger 95 can be modified independently to achieve the desired delivery pattern.

Figure 16:
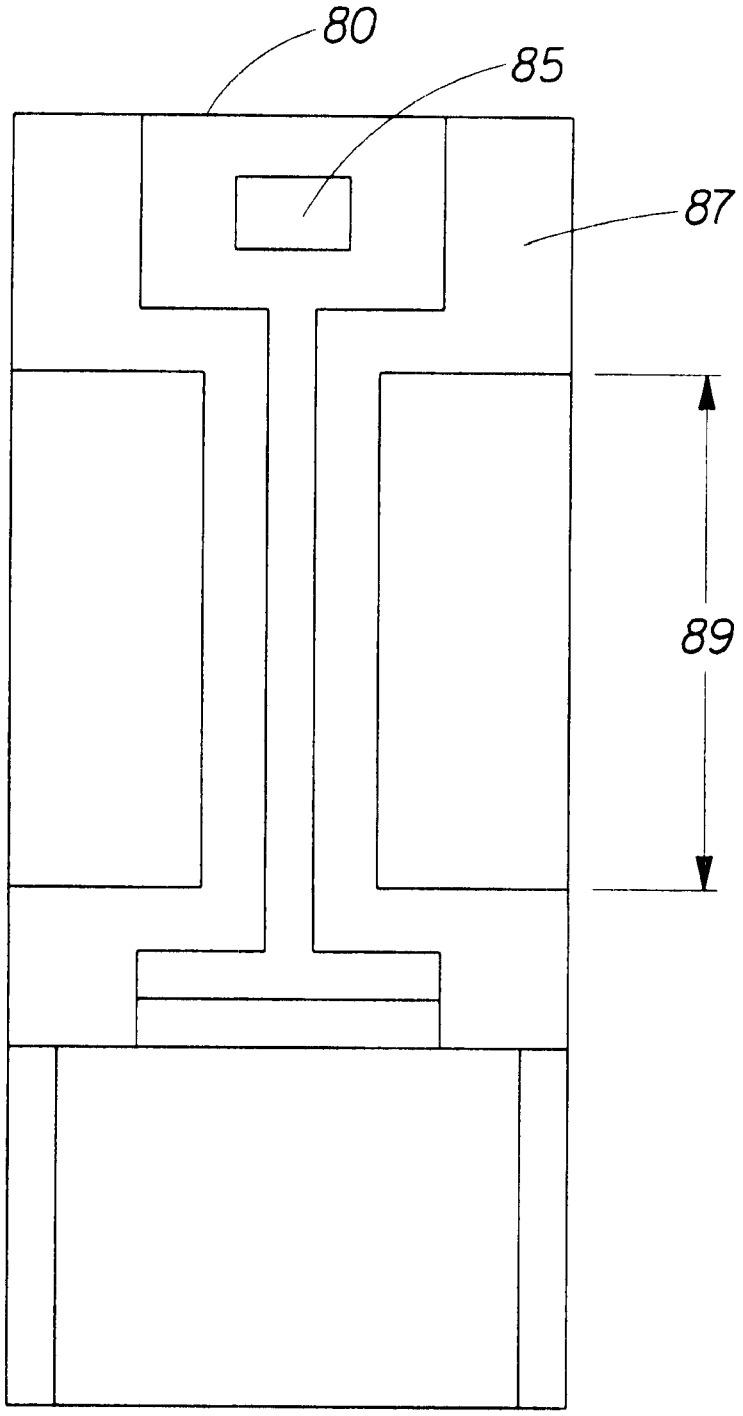
FIG. 16 is a plan view of another embodiment of a rupturable reservoir suitable for use in accordance with the present invention.

FIG. 16 shows another example of a distribution head that aids in delivering a desired dosing effect. Similar to some versions of the distribution head that slow product release by changing the direction of the product flow and providing exit locations larger than the delivery channel, such as shown in FIGS. 14 and 15, this particular embodiment utilizes a seal 85 in the center that acts as a baffle to prevent product from exiting too quickly or with too much force and running off the substrate. The end 80 is not sealed and serves as the exit location. The side seals 87 force the fluid forward as it is released from the pouch; thus, directing fluid to the desired location. This reservoir would be useful in delivering product near the fingertips in a mitt while still allowing the delivery channel length 89 to be minimized. Alternatively, one or more of the sides may not be sealed and serve as an alternate or as an additional exit location for the fluid.

FIG. 6 is one example of a more complex reservoir design. The reservoir 30 of FIG. 6 includes a plurality of outlet ducts 41, a plurality of distribution apertures 42, and an elongated channel 44 which separates the chamber 47 from the distal end 43 of the assembly. Fluid flow between the chamber 47 and the channel 44 is controlled by the frangible or rupturable seal 45, which illustrates the use of a stress-concentration notch 46. The channel 44 may be of a material and configuration such that it is "self-sealing" and collapses shut to restrict, if not preclude, fluid flow except when the chamber is substantially pressurized. For example, a channel may be formed by making two substantially parallel seals along facing layers of a pouch, where the space between these seals becomes a channel for fluid to move from the reservoir to the distribution aperture(s). The channel will naturally lay flat (and thereby closed) due to the seals, but will become almost tubular when the reservoir is pressurized and filled with fluid traveling through the channel. Upon release of the pressure, the channel will tend to naturally return to its flat state, causing a sealing effect to prevent further product delivery. The dimensions of the channel can be optimized based upon the viscosity of the product being dispensed from the reservoir. For example, a reservoir designed for dispensing a relatively thick lotion or cream product will preferably have a wider channel than a reservoir designed for dispensing a relatively lower viscosity product. In one embodiment, the channel width is selected to allow "resealing" of the channel by withdrawing pressure from the reservoir 30 and allowing product to back into the channel while not requiring excessive force on the pouch to pressurize the channel. Resealing of the channel can provide for dosing or progressive fluid dispensing. The outlet ducts and/or the apertures can be used as desired, with one or the other being employed or both in combination. Other approaches to provide dosing capability (i.e., multiple discrete dispensing cycles) include providing multiple reservoirs on either or both sides of the applicator.

Figure 13:
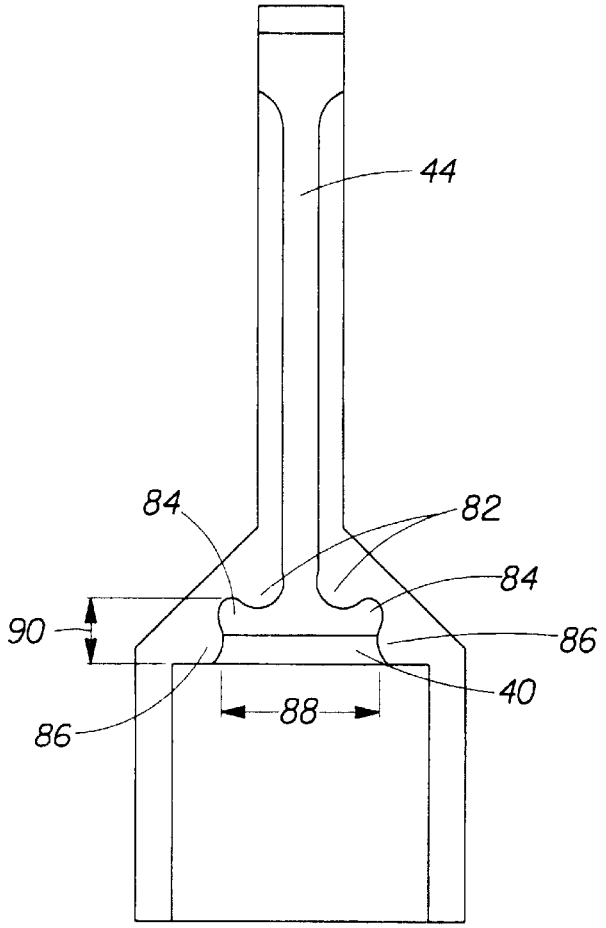
FIG. 13 is a plan view of another embodiment of a rupturable reservoir suitable for use in accordance with the present invention.

Additional functionality may be added by providing dosing. FIG. 13, for example, shows one such embodiment with additional features for controlling dosing. Areas 82 of the lock up seal aid in the prevention of over-dosing by inhibiting fluid flow through the dosing channel once activated. Thus, the user feels an increase in resistance when squeezing or pressing the pouch. Areas 84 are preferably not sealed and extend beyond the end of the dosing channel. Once the cell is pressurized, these areas 84 fill and provide a more rigid three-dimensional structure to the cell and prevent the channel from folding and clamping shut. Areas 86 of lock up seal can be added to provide a "target zone" for the frangible seal. Thus, burst force consistency is improved by limiting the width 88 of the frangible seal 40 and manufacturing is made easier by having a larger zone 90 where the frangible seal can be located. Area 86 also aids in forming a natural fold line for protecting the frangible seal.

Dosing may alternatively be accomplished without the use of a dosing reservoir or distribution channel. For example, a rupturable reservoir such as shown in FIG. 4 may be combined with a flow restriction layer. The flow restriction layer may be a separate layer in the mitt 10 such as the front panel 24, the layer 37, or be an additional layer that is between layer 37 and the reservoir 30. Non-wovens, apetured films, thermoformed films, and other materials, for example, can be created to have a target porosity and thus fluid flow rate. Controlling the mean size of openings, position, and the number of openings in the flow restriction layer can determine how fast a fluid or product will be dispensed through the front or back panel. The fluid flow rate can be controlled by incorporating the desired porosity in the front or back panel materials or can be accomplished by having a separate layer or layers between the reservoir 30 and the application surface of the mitt 10. An example of a flow restriction layer is a 100 mesh hydroapetured film made from low density polyethylene. The apertures in this structure are approximately 100 micron in diameter and may be suitable for controlling the fluid rate of creams and lotions, for example. The number and size of the holes can be adjusted depending upon the viscosity of the fluid being dispensed and the desired application rate.

A reservoir 30 having a frangible seal connected to a distribution channel 44 such as shown in FIG. 6, for example, can provide fluid communication with one or more distribution apertures located in a region or application surface of the mitt removed from the location of the reservoir 30 itself.

Figure 12:
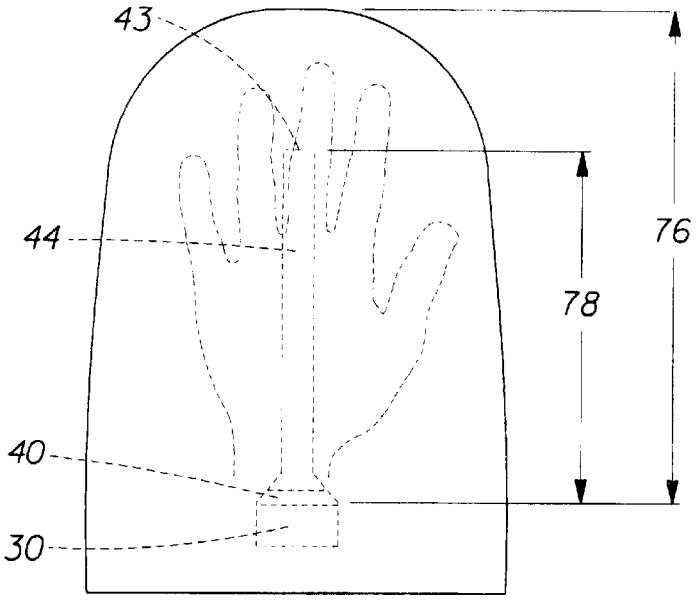
FIG. 12 is a plan view of another embodiment of a semi-enclosed applicator in accordance with the present invention, also in the form of a mitt, showing the user's hand in phantom.

As shown in FIG. 12, for example, a reservoir 30 can be located near a cuff region of the mitt such that the reservoir 30 and the frangible seal 40 are located below the palm of the wearer's hand and the distribution channel 44 provides fluid communication to a portion of the mitt corresponding to the position of a user's fingers in use. In one embodiment, the distance 76 from the tip of the closed side of the mitt 10 where the fingers of the wearer's hand are located to the frangible seal 40 can be in the range from about 14.6 centimeters to about 19 centimeters thus allowing the frangible seal to remain clear of the pressure applied by the palm of the wearer's hand of about the 97.5 percentile of women (16.8 centimeters) and of the 97.5 percentile of men (18.5 centimeters). See e.g., Dreyfuss, Henry, *The Measure of Man,* New York; Whitney Library of Design (1969), incorporated by reference herein. This location, for example, can space the reservoir away from the region of the mitt that would typically encounter application and forces in use, and may allow for sequential dosing of the product in the reservoir by requiring activation by specifically applying force to the cuff region for selectively dispensing the fluid. In this embodiment, the fluid would travel through the channel to the distribution head where the fluid is released on the desired location of the mitt, such as near the fingers in the preferred embodiment. Additionally, multiple reservoirs can be advantageously placed at different locations of the mitt 10.

The reservoir preferably uses a laminate film that contains either metallized PET, aluminum foil, $SiO_2$ or some other high barrier material that will provide an adequate moisture and/or oxygen barrier to allow the product to have a reasonable shelf life. In one embodiment, for example, the substance may have a shelf life in the range from about 2 years to about 3 years. Smaller reservoirs with small amounts of a product require even a higher barrier since the surface area to volume of fluid is significantly higher resulting in higher levels of moisture loss due to transport and diffusion.

The reservoirs can be made rupturable or "frangible" by a number of different techniques. One preferred technique is to make a pouch on a vertical or horizontal form/fill/seal machine that has the ability to make different seals on the pouch at different temperatures, pressures or seal times. This allows one side of a pouch to have different sealing conditions that in turn can allow one side to have a weaker seal strength. A suitable sealant material for this type of "frangible" seal would be Surlyn® made by Dupont or a blend of Polybutylene with Ethylene Vinyl Acetate or ultra low density ethylene copolymers, polyolefin plastomers, and/or Polyethylene. Sealant layers made with either of these resins or blends will result in a sealant layer that will have significantly different seal strengths depending upon the seal temperature. The blend provides a "contaminant" to the base polymer material that allows the resulting seal to be selectively frangible under certain sealing conditions. For example, at 200 degree F. the sealant layer will deliver a seal force of 200–400 grams/linear inch of seal width and at 300 degree F. the seal force will deliver a seal force closer to 3000 grams/linear inch of seal width. This variation in seal strength allows a pouch to be "welded" shut in one portion and easily burstable in a second portion just by adjusting the seal temperature, the seal time and/or the seal pressure used when making the pouch seals (e.g., the pouch may be welded along all or a portion of one, two, three or more sides and easily burstable along a portion of one, two, three or more sides). A preferable film structure for this type of frangible reservoir would be Surlyn sealant/tie layer/metallized PET. Other techniques for making the consumer activated rupturable reservoirs include delaminating seals, weak regions in the film structure such as created by embossing, laser scoring, mechanical scoring or other known methods of weakening a film structure, and small thermoformed cells with thin regions that rupture when squeezed (similar to bubble wrap). Alternatively, a reservoir 30 may have other opening means such as tear-off strips, pull tabs, release liners and the like.

Front Panel

In accordance with one embodiment of the present invention, the front panel 24 preferably comprises a porous, such as a fibrous non-woven, embossed substrate material through which the product within the reservoir 30 can be dispensed. The material utilized for the front panel 24 is preferably substantially hydrophobic to aid in moving the substance on the shoe during application, provide sufficient strength for durability during application, provide sufficient space within the embossed pattern to allow proper polishing substance delivery onto the surface and supply sufficient space within the polymeric surface arrangement to permit proper retention of excess of applied formula. The material should also preferably be non-absorbent and/or preferably substantially hydrophobic when utilized with water-based liquids, in order to provide for residence time of the liquid upon the target surface. Non-absorbent fibers in a non-woven, for example, do not absorb water and thus do not swell when exposed to an aqueous based product. Exemplary fibers that may be used in a non-woven include cellulose, polyolefin, such as polyethylene and polypropylene, and polyester fibers. An acceptable non-woven can be made, for example, by known methods such as spunlace, spunbond, meltblown, carded, air-laid, hydroentangled, and the like. Alternatively, a porous non-woven, an apertured film or web can also be used as a porous non-absorbent material for the front panel 24. Suitable materials for use as a front panel 24 can also provide sufficient strength and texture characteristics so as to provide a rubbing action upon the target surface and to maintain web integrity when exposed to the product. A thermoplastic-based non-woven substrate such as a polypropylene, polyethylene, or polyester based non-woven substrate, for example, can effectively meet these criteria while also not absorbing water based product formulas. One such material sufficient in durability and strength to provide a cleaning surface, for example, is a spunbond polypropylene non-woven such as from BBA Non-wovens of Simpsonville, S.C. Other structures such as hydroentangled materials comprising cellulose, rayon, polyester, and any combination thereof may also be used. One such set of materials are made by Dexter Corporation of Windsor Locks, Conn. and sold under the trade name Hydraspun®. The front panel may also be constructed from paper having multiple basis weights.

Preferably the multiple basis weight paper has two or more distinguishable regions: regions with a relatively high basis weight, and regions with a relatively low basis weight. Preferably the high basis weight regions comprise an essentially continuous network. The low basis weight regions may be discrete. If desired, the paper according to present invention may also comprise intermediate basis weight regions disposed within the low basis weight regions. Such paper may be made according to commonly assigned U.S. Pat. No. 5,245,025, issued Sep. 14, 1993 to Trokhan et al., the disclosure of which is incorporated herein by reference. If the paper has only two different basis weight regions, an essentially continuous high basis weight region, with discrete low basis weight regions disposed throughout the essentially continuous high basis weight region, such paper may be made according to commonly assigned U.S. Pat. No. 5,527,428 issued Jun. 18, 1996 to Trokhan et al.; U.S. Pat. No. 5,534,326 issued Jul. 9, 1996 to Trokhan et al.; U.S. Pat. No. 5,654,076, issued Aug. 5, 1997 to Trokhan et al., and U.S. Pat. No. 5,820,730, issued Oct. 13, 1998 to Phan et al., the disclosures of which are incorporated herein by reference. One skilled in the art will understand that a wide range of materials can be used as long as the material of interest provides the required durability to complete the particular task.

A non-woven typically does not swell with the product and releases the product when rubbing with minimal retention compared to a disposable paper based towel. Further, a thermoplastic non-woven has good wet strength and adequate scrubbing capability yet will not scratch many target surfaces. The non-woven also has a low coefficient of friction that allows the substrate to glide very easily across a target surface with minimal effort and allows good ease of spreading the product onto the target surface.

In order to protect the hand of the user from contact with the product during the dispensing and/or dispersing operation, the mitts of the present invention can include a barrier layer 25, the interior of which defines the front inner surface 32 that faces the wearer's hand during use. The barrier layer 25 is preferably impervious to the product contained in the reservoir 30. Suitable barrier materials include polymer films, such as polyethylene, polypropylene, EVA, and polymer blends or co-extrusions, which may be rendered extensible by methods described below. Materials that are embossed, whether or not extensible, provide improved tactile properties and greater control over the applicator in terms of contact and coefficient of friction with the hand. Preferably, the material and the surface are made such that the coefficient of friction between the inner surface 32 and a wearer's hand is greater than the coefficient of friction between the outer surface 33 and the target surface. This reduces the likelihood that the mitt 10 may slip or rotate inadvertently in use. The barrier layer can also be combined with another "softness enhancing" material that provides additional comfort, softness and tactile feel to the user's hand on the front inner surface 32. Such materials can include, but are not limited to, fibrous (natural, synthetic or combinations thereof) and/or foamed materials.

Figure 9:
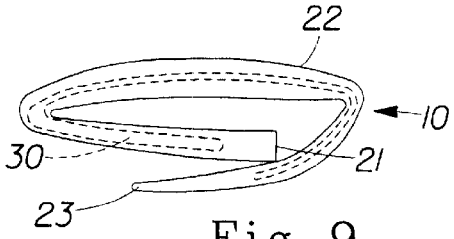
FIG. 9 is an elevational view of an applicator similar to that of FIG. 3 which is folded in the vicinity of the rupturable seal of the rupturable reservoir.

In some embodiments, the pouch is able to rupture at a relatively low force, such as in the range from about 1 pound to about 3 pounds, when the consumer is ready to use the mitt, but the pouch is able to survive relatively higher forces, such as in the range from about 10 pounds to about 40 pounds, when the mitt is in distribution to the store or handled in the box on the store shelf. The desired rupture force can be provided by folding the pouch on the frangible seal or between the frangible seal and the reservoir, preventing the pouch from bursting and generally protecting the pouch from undesired rupture and premature fluid dispensing. In some embodiments, for example, this technique has been shown to effectively raise the bursting force to a level in the range from about 30 pounds to about 40 pounds. This can be accomplished by folding the mitt into a compact unit, which also aids in packaging and display. As shown in FIG. 9, the mitt may be tri-folded such that the frangible seal is protected and the distribution head is also folded to provide an extra level of protection on the seal.

Figure 7:
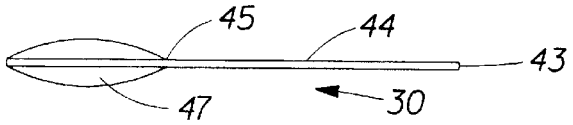
FIG. 7 is an elevational view of the rupturable reservoir of FIG. 6.
Figure 8:
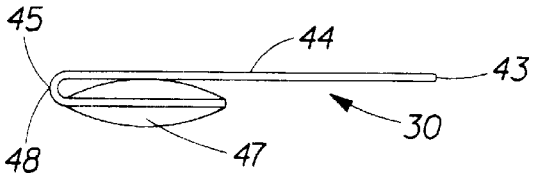
FIG. 8 is an elevational view of the rupturable reservoir of FIG. 7 folded in the vicinity of the rupturable seal.

FIG. 7 is an elevational view of the reservoir of FIG. 6 and FIG. 8 illustrates the use of folding techniques to protect a frangible seal from premature rupture. FIG. 8 illustrates a reservoir 30 consistent with that of FIGS. 6 and 7 which has been folded at location 48 adjacent the rupturable seal 45. Folding the reservoir in effect crimps, or pinches off, the fluid pathway allowing the reservoir to withstand increased internal pressure without leakage than would normally be desired for the frangible or rupturable seal relied upon for dispensing functionality.

FIG. 9 illustrates the tri-folding of an applicator 10 to isolate the fluid-containing reservoir 30. As shown in FIG. 9, the additional fold in the vicinity of the distal end of the reservoir 30 may serve to provide additional security against premature dispensing by isolating the fluid outlets from the remainder of the reservoir. Bi-fold, tri-fold, z-fold, or any suitable folding pattern may be utilized to provide not only a more compact applicator, such as when a plurality of applicators are folded, stacked, and then placed within a carton, sleeve, or outer wrapper, but also provide desirable functionality in terms of providing enhanced resistance to premature activation via a higher dispensing threshold prior to the point of use.

Another means of reducing pre-mature bursting is the use of a secondary crimping device that "clamps" the frangible seal and prevents pre-mature bursting until the crimping device is removed. This crimping device could be a low cost injection molded part such as a flexible clip or paper clip-like structure. The crimping device should have enough biasing force to keep the pouch in a generally flat condition adjacent the frangible seal or any region where protection from bursting is needed. A third approach is to have a pouch that is only partially filled but when folded on the reservoir has the right fill volume that allows the pouch to be burst when squeezing. When flat, the pouch can be squeezed and not burst since the fluid can flow to other portions of the pouch before the two sides of the pouch touch each other and bottom-out when squeezing.

Back Panel

The back panel 26 may aid in keeping the mitt 10 on the hand or finger(s) of the user. The back panel 26 may further serve to enclose the hand or finger(s) of the user, and may even serve additional functions such as removing a product applied to a surface via the front panel 24. The back panel 26 may be constructed of materials such as one or more films, non-wovens, scrims, papers and/or the like.

After the product has been dispensed and dispersed onto the target surface, for example, it is sometimes desirable to absorb and remove excess product, contaminates and/or particles from the target surface while minimizing filming, streaking and/or residuals. Accordingly, the back panel 26 of the mitt 10 can be made from a material that is substantially absorbent for the product of interest. For example, the back panel 26 may be constructed of absorbent fibers that swell when exposed to the product of interest (e.g., liquids such as water, oils, etc.). Examples of absorbent fibers include man-made fibers derived from cellulose (e.g., rayon, cellulose acetate, cellulose triacetate) and natural cellulose fibers (e.g., from trees). Other examples of absorbent materials include particles and fibers made from super-absorbent polymers (e.g., crosslinked copolymers of acrylic acid) that can be incorporated into the back panel 26. Additionally, or in the alternative, the back panel 26 may be constructed of non-wovens, apertured films, absorbent or fibrous absorbent materials, super absorbent polymer fibers or powders, laminates, a selectively apertured composite material as shown in U.S. Pat. No. 5,916,661 to Benson et al., herein incorporated by reference, and/or combinations thereof. Absorbent non-wovens may be made by methods such as spunlace, spunbound, meltblown, carded, air-laid, and hydroentangled.

As described above, one side of the applicator may be designed with a majority of non-absorbent fibers (termed "substantially non-absorbent") and the other side may be designed with a majority of absorbent fibers (termed "substantially absorbent"), or a film. In the context of the invention, these terms are relative to one another. Depending upon the specific application, the product to be spread, the environmental conditions, and the benefits sought, the amount of product that the substantially absorbent side absorbs and the amount of product the substantially non-absorbent side absorbs will not be constant. Rather, the substantially absorbent side will have a relatively higher absorbent capacity than the substantially non-absorbent side for the particular product. The ratio of the absorbent capacity of the substantially absorbent side to the absorbent capacity of the substantially non-absorbent side is greater than one, preferably greater than two, and more preferably greater than four.

In some embodiments, the mitt 10 can have multiple layers on either the front panel 24 or the back panel 26 to provide additional application and/or polishing surfaces. Preferably, additional layers can be heat sealed only to the perimeter and sealed in such a way that the layer is peelable. However, layers may be attached and removed by other methods such as perforations, peelable adhesives, and the like. The additional layers are intended to be removed without tearing of the applicator. The layers can be slightly offset at the cuff region 21, or additional material such as tabs may protrude from the layer, making it easier for the user to remove one layer at a time. Peelable heat seals may be accomplished by heat sealing the individual layers at a lower temperature or with less seal time such that a peelable seal occurs. These layers can also be made peelable by using a contamination layer or other methods known in the art. An example of how peelable layers can be used would be for a shoe polish mitt where shoe polish is applied. During application of the polish, the mitt surface 31 becomes soiled to an undesirable level after the desired amount of polish is applied. To overcome this, an extra layer(s) of a non-woven material, a composite material that is selectively apertured, or the like could be used under the front panel 24 allowing the user to peel off the soiled layer, delivering a new, clean polishing layer allowing the user to continue polishing to the desired sheen. Similarly, the absorbent back panel 26 could have multiple layers of an absorbent paper towel such as Bounty® towel made by The Procter & Gamble Company. The absorbent backside layers could be coated with a thin coating of a barrier material such as Polyethylene that prevents polish from contacting other layers except for the outer layer that is being used. When this outer layer becomes unusable, the outer layer can be removed exposing a new clean layer.

The front inner surface 32 and the back inner surface 34 may be optionally provided with friction-enhancing elements or coatings 28 to prevent slippage between the wearer's hand and the back inner surface. The friction-enhancing elements or coating 28 on the back inner surface, for example, may reduce the likelihood of the mitt rolling or rotating of the mitt upon the hand when the frictional forces between the back panel and the increasingly dry target surface escalate. The coating can also be applied in a foamed state such as by the addition of physical blowing agents such as nitrogen and/or carbon dioxide. In addition to slot coating, suitable materials can be applied (foamed or unfoamed) in one or more of an array of lines, spirals, spots and/or any other patterned network, by spraying, gravure printing, or by adhesively or otherwise securing separate pre-formed elements. In addition, tape or mechanical fasteners may also be used to prevent slippage between the wearer's hand.

In one embodiment, an inner surface, such as the back inner surface 34, may have a friction-enhancing element that has a higher coefficient of friction between its surface and the wearer's hand than the coefficient of friction between the outer surface, such as the back outer surface 33, and the target surface. A friction-enhancing element in this embodiment would preferably be a coating that delivers a higher coefficient of friction between a wearer's hand and the back inner surface 34 of the mitt 10 such that the mitt 10 does not slip or rotate on the hand when buffing the target surface with the back panel 26.

Figure 17:
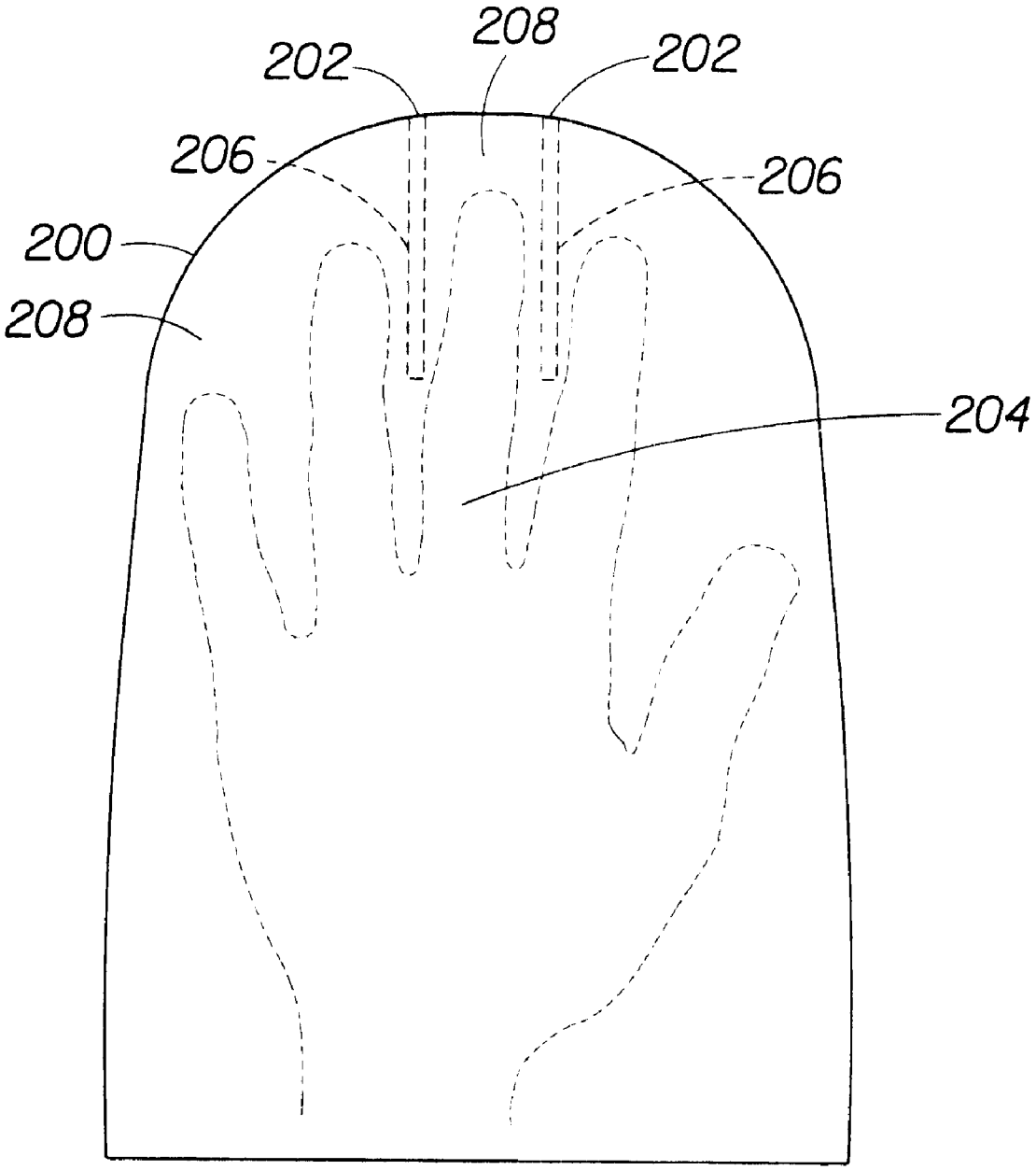
FIG. 17 is a plan view of a mitt with seal line elements to aid keeping mitt from shifting on hand during use; and, FIG. 18 is an exploded perspective view of a polishing mitt suitable for use in accordance with the present invention.

Alternatively, as shown in FIG. 17, the mitt 10 can be bonded or combined with one or more seals to provide a full or partial pocket for one or more fingers of the user. The line seal 206 may prevent the mitt 10 from rotating on the hand of the user, and may further provide a means for gripping the mitt when the fingers are pressed together during use. The line seal 206 may form a partial pocket 208 for one or more fingers and may, for example, extend from the outside perimeter 200 at the top 202 of mitt 10 towards the cavity 204. In one embodiment, the line seal may extend a distance from about 2 inches to about 4 inches from the outside perimeter 200 of the mitt 10. In another embodiment, the back of the mitt 10 can be a simple strap extended from one side of the mitt 10, across the back of the user's hand, and fastened to the opposite side of the mitt.

In use, a wearer of the mitt 10 inserts a hand into the hollow interior through the provided opening at the cuff region 21 wherein the back panel contacts the back of the wearer's hand and the front panel contacts the wearer's palm. As the construction of the mitt 10 is more generic than a glove with defined anatomically-conforming geometry, the mitt may be used for either hand and/or may be appropriately sized to fit the foot of a wearer or any other bodily extremity.

If desired, at the end of its use, the mitt can be inverted by making a fist with the mitt-hand, pulling the structure over the fist from the cuff region 21 of the mitt 10. Thus the layers are transposed, and the inner surface of the front panel and the inner surface of the back panel become the outer surfaces of the now waste article. More simply stated, the mitt is turned inside out after its use and then thrown away. That is, the wearer makes a fist, and with his or her other hand, grasps a point on the cuff region and carefully pulls the fisted hand toward the open mouth of the mitt, until the entire end of the mitt is pulled through the cuff.

In one embodiment, the mitt 10 may be a differentially extensible hand article wherein at least a portion of the mitt extends and/or contracts about a wearer's hand and/or wrist without the use of traditional elastic such as natural or synthetic rubber. By the term "differentially extensible" or "differential extensibility" it is meant herein to describe that quality of extensibility wherein portions of the glove extend or contract independently of other portions in response to varying hand sizes and motions. Preferably, this differential extensibility allows a range of hand sizes to fit comfortably within the mitt. The mitt 10 may be provided with differential extensibility by utilizing a structural elastic-like film web such as those described in commonly-assigned U.S. Pat. No. 5,518,801, issued to Chappell, et al. on May 21, 1996, and U.S. Pat. No. 5,650,214, issued Jul. 22, 1997 in the names of Anderson et al., and commonly-assigned, U.S. patent application Ser. No. 08/635,220, filed Apr. 17, 1996 in the names of Davis et al., entitled "Fitted Glove", the disclosures of each of which are hereby incorporated herein by reference. Alternatively, differential extensibility to fit varying sized hands comfortably can be accomplished by various elastic-like materials, composite materials that produce elastic-like characteristics and/or processes to make a material(s) more elastic-like. Examples of suitable elastic-like materials include low density polyolefins such as low density polyethylene, linear low density polyethylene, ultra low density ethylene copolymers (copolymerized with alpha-olefins such as butene-1, octene-1, hexene-1, etc.), Affinity® polyolefin plastomers produces by Dow Chemical Company of Midland, Mich. and Exact® polyolefin plastomers produced by Exxon Chemical of Houston, Tex. As used herein, the term "elastic-like" describes the behavior of web materials such as web materials which, when subjected to an applied elongation, extend in the direction of applied elongation. Also, when the applied elongation is released the web materials return, to a substantial degree, to their untensioned condition. The term "laminate" as used herein refers to a sheet-like material comprising a single layer of material or a laminate of two or more layers.

Additionally a non-woven material can be attached to the edges of the differentially extensible hand article wherein at least a portion of the mitt extends and/or contracts about a wearer's hand and/or wrist without the use of traditional elastic such as natural or synthetic rubber. Such a non-woven material is useful to prevent contamination of the user's hand by the applied substance during buffing of the object.

To facilitate spreading or dispersal of the substance upon the target surface, particularly to counteract the tendency of the substance to remain in a localized distribution pattern given the localized orientation upon the deformable substance, it is presently preferred to utilize substances which are tailored so as to be wettable on the target surface. Other factors which may aid in dispersion or distribution of the substance upon the target surface include the use of substances which exhibit a shear-thinning behavior, as well as mechanical spreading action provided by the user of the composite sheet material to impart a lateral mechanical motion after activation but prior to removal of the deformable material from the target surface. Such lateral mechanical action may also provide additional interaction with the substance such as for shear-thinning substances and may provide additional benefits such as lathering, foam generation, scrubbing/abrasive action, etc.

Successful dispersal occurs when a portion of the deposited or dispensed product subsequently coats a portion of the target surface where the substance was not originally deposited. Upon removal of the sheet material from the target surface, at least some of the substance remains located on the target surface, preferably in a substantially-uniform fashion.

The mitts of the present invention have multiple possible methods of use. In one embodiment, the mitts are folded so as to protect the product reservoir from pressure. Users may conveniently remove the mitts from a container, unfold the mitt and fit one of their hands through the mitt aperture. The reservoir pouch can be actuated to release the product. This can be achieved by any suitable method such as pressing on the reservoir pouch with one or more fingers, with the palm of the free hand, or by pressing the pouch against a solid surface. The amount dosed can be controlled by instructing the user to press the reservoir pouch so as to release an amount of fluid consistent with parameters that are either printed on the instructions for use, or written or graphically illustrated directly on the front panel 24 side of the mitt, or written or graphically illustrated directly on the reservoir 30.

Manufacturing Process

Figure 10:
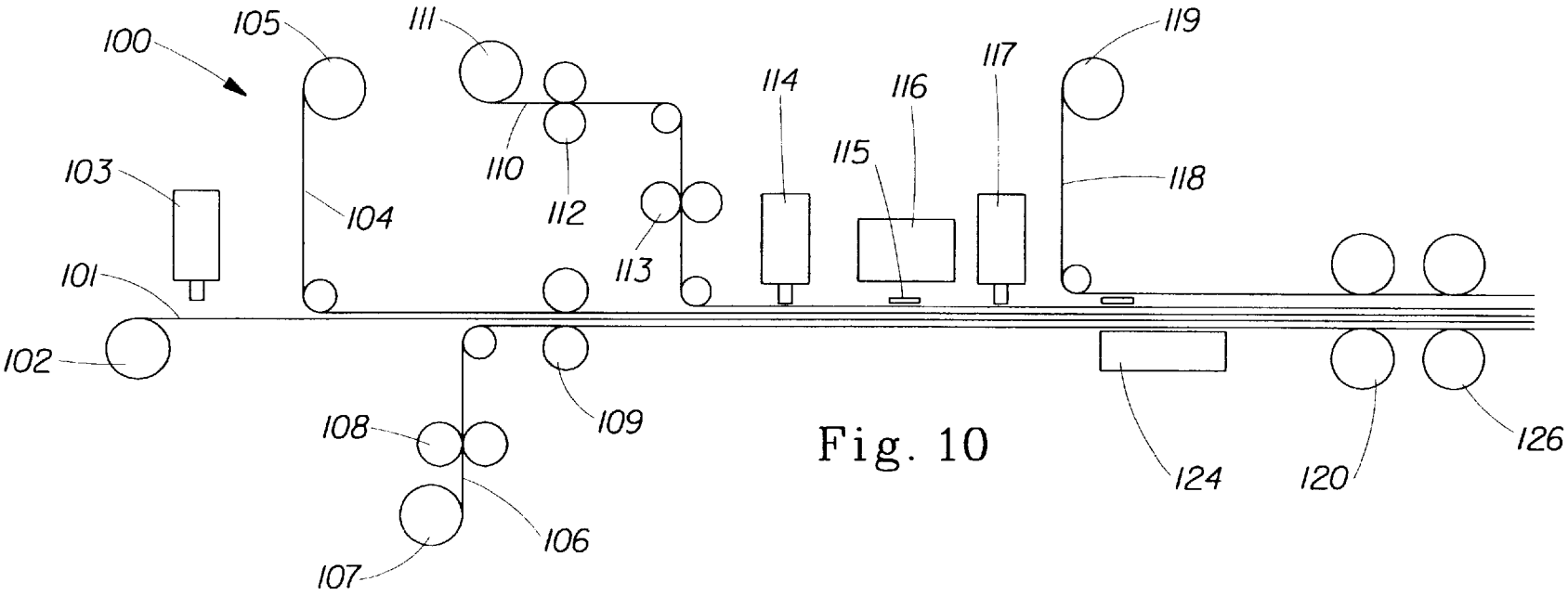
FIG. 10 is a schematic illustration of an applicator manufacturing process in accordance with the present invention.
Figure 11:
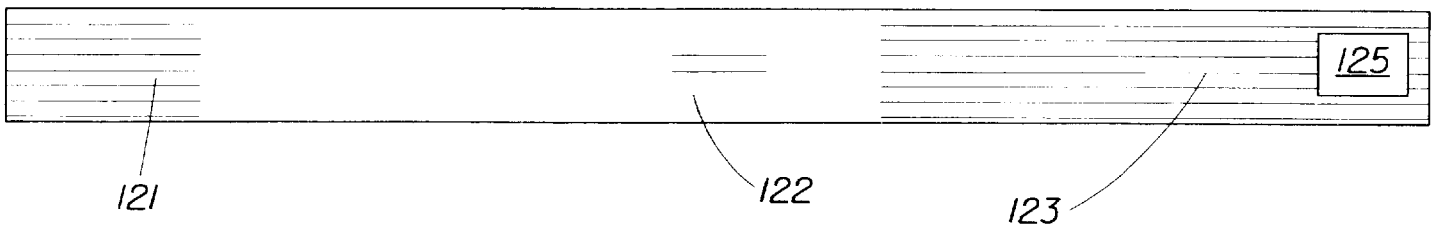
FIG. 11 is a plan view of the process of FIG. 10.

A manufacturing process suitable for manufacturing applicators in accordance with the present invention is schematically illustrated in FIGS. 10 and 11.

As shown in FIG. 10, the process 100 begins with the feeding of a first web 101 from a supply roll 102. The first web 101 corresponds to the impervious barrier 50 of FIG. 18. A glue applicator 103 applies a thin layer of adhesive 121 to the upper surface of the first web 101 in a suitable pattern for substantially uniform coverage, such as a spiral pattern as shown more clearly in FIG. 11. The adhesive is used to establish a bond between the first web 101 and the second web 104, which is fed from a supply roll 105, to form a composite web. The second web 104 corresponds to the buffing substrate 56 shown in FIG. 18.

Next, a third web 106 fed from a supply roll 107 through a pair of opposing rolls 108, optionally performing an "elasticizing" operation to selectively strain the web to impart elastic-like properties as described above, is sealed against the side of the first web 101 of the composite by means of a suitable apparatus 109. Suitable, but non-limiting sealing includes, continuous rotary heat sealing, ultrasonic, and high pressure compression. Suitable sealing may be used to join the third web to the remainder of the composite web by forming a peripheral seal around the edge of what becomes the finished applicator, such as a mitt, in the desired outline shape.

A fourth web 110, is then fed from a supply roll 111 through a pair of opposing rolls 112 that can perform an "elasticizing" operation to selectively strain the web to impart elastic-like properties, as described above.

The activated web 110 is then fed into a gravure roll or like apparatus 113 that applies adhesive to form a peripheral seal around the edge of the delivery section of the applicator 58. The delivery section of the applicator 58 is removable from the finished applicator, such as a mitt.

Once the fourth web 110 has been secured to the second web 104, a glue applicator 114 applies beads of adhesive 122 to the upper surface of the fourth web 110 as shown more clearly in FIG. 11. The glue applicator 114 secures reservoir 115 in place.

At least one reservoir 115 (corresponding to reservoir 30 of FIG. 2) is placed in the appropriate location in relation to the web dimensions so as to be located within the dimensions of the finished applicator. Any suitable apparatus 116, such as a "pick and place" apparatus, may be utilized to place the reservoirs 115 upon the traveling composite web.

A glue applicator 117 applies a thin layer of adhesive 123 to the upper surface of the fourth web 110 in a suitable pattern for substantially uniform coverage, such as a spiral pattern as shown in FIG. 11. The adhesive is used to establish a bond between the fourth web 110 and the fifth web 118 fed from a supply roll 119, encapsulating the reservoir against forth web 110. Fifth web 118 corresponds to delivery substrate 53, shown in FIG. 18.

The web 118 is then applied to the composite web over reservoirs 115, and is held in a tensioned condition via the use of any suitable apparatus 124, such as a "vacuum conveyor". The composite web then passes through a sealing/bonding apparatus 120, such as a pair of compression rolls (with cavities as necessary to avoid prematurely rupturing the reservoir 115), which bonds the web together with the barrier layer in a stretched or unstretched condition.

Finally, a rotary die cutting apparatus 126 severs the finished applicator from the excess material of the rest of the web to form finished applicator or mitt 125. Finished applicators may then be folded, if desired, via the use of folding boards or other suitable apparatus (not shown) and packaged as desired.

Processing conditions for the above process may be determined in accordance with procedures known in the art for establishing suitable operating conditions such as seal temperatures, nip pressures, line speeds, and the like.

EXAMPLE 1

Figure 18:
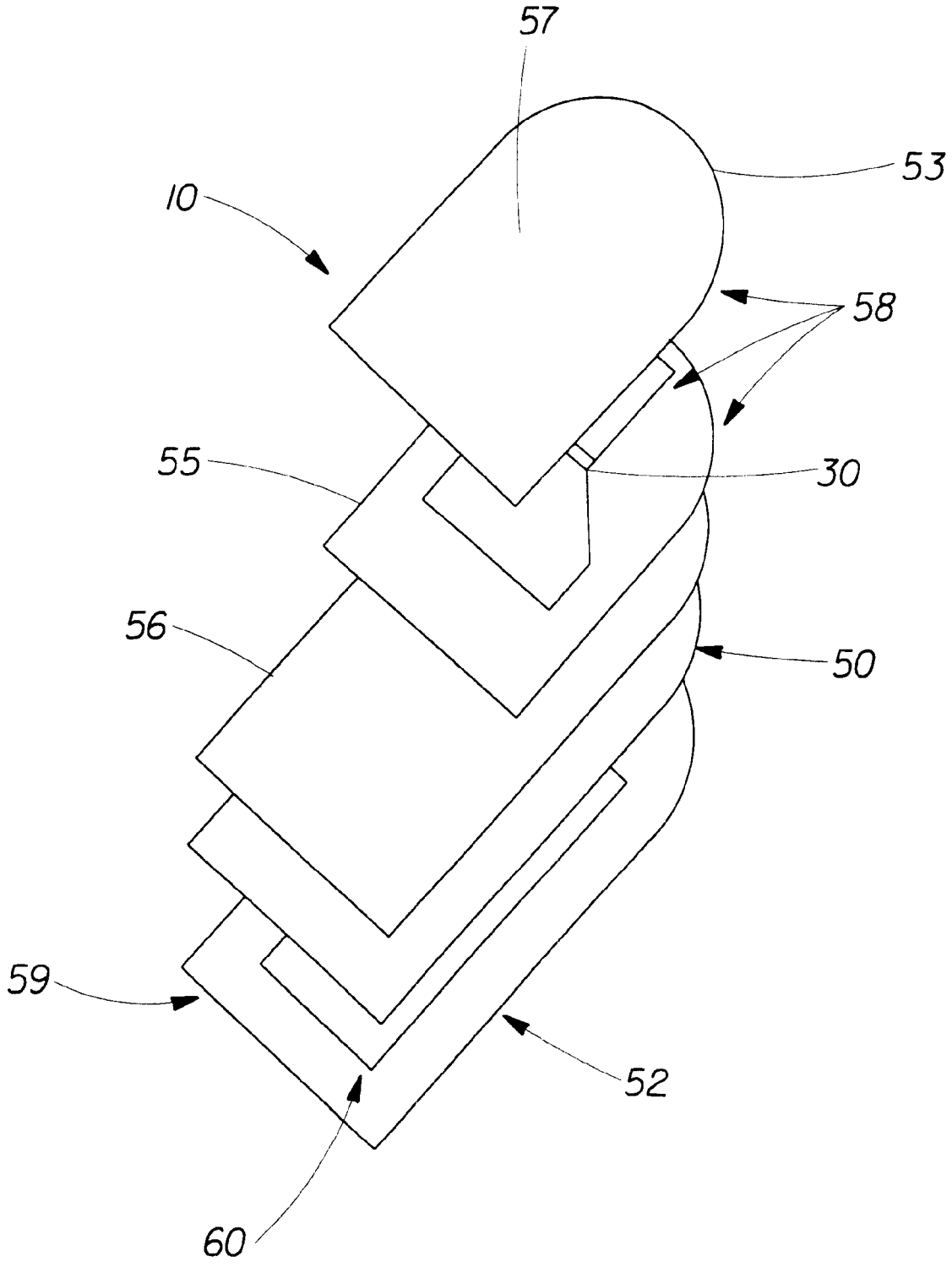

As shown in FIG. 18, a polishing mitt such as for use with shoes may be made in accordance with the present invention. The polishing mitt can consist of a multiple layer mitt. An impermeable mechanically activated polymeric film 50, laminated to the third layer, or buffing substrate 56, forms the palm side of the mitt. Such film may be bonded to a non-woven film to form the core pocket of the mitt 52. These two materials 50 and 52 are the only ones in contact with a user's hand or fingers during use. The mitt can be worn with first layer 53 and external surface, or side 57 of first layer 53 facing the surface to be treated. This is the cleaning, conditioning and buffing side, while layer 52 and side 58 are used to hold the mitt in place and to provide ventilation and breathability to a user's hand. Layers intermediate to side 57 and underside 59 are described herein.

First layer 53 is provided as a non-woven embossed substrate with specific properties for enhanced use as the external layer of the delivery system. Properties of the non-woven substrate for the delivery system side should be a) hydrophobic, b) or sufficient strength for durability during scrubbing c) sufficient space within the embossed pattern to allow proper polishing substance delivery onto the surface and d) sufficient space within the polymeric surface arrangement to permit proper retention of dust and excess of applied formula.

Beneath this substrate lays a laminated film in which cell 30 is filled with a polishing/conditioning active. The laminated film is sealed against itself thus forming an encapsulated cell of active material. The cell 30 lays beneath a non-woven substrate 53 in such a way that the cell 30 discharges toward the non-woven external substrate. The rupture of the cell 30 is produced through a frangible wall seal upon sufficient pressure is applied to the cell. This releases the active through a channel 44 towards the first layer 53.

The amount of released active is estimated as per the needed amount to clean a reasonably soiled pair of leather shoes (approx. 5.0 ml) and can be controlled by the user. For the cleaning of other surfaces mentioned above to which the same kind of product, implement and/or technology could be applied, other quantities and active ingredients may be released accordingly. Special care should be directed when formulating the actives for cleaning to: a) the compatibility of the active with the chosen films forming the cells, b) the rate of diffusion of the active through the encapsulating material which will dictate the rate of active loss, c) the viscosity and other physical properties of the active which will dictate much of the handling and filling operations.

Beneath the cell 30 lays second layer 55, generally comprising an impermeable plastic film, which is bonded against the first layer 53. This forms the active delivery system. Second layer 55 holds the cell 30 against the non-woven or selectively apertured composite material first layer 53, while protecting the buffing surface 56 from polishing agent contamination.

The buffing substrate 56 is located beneath the polishing agent delivery system 58, comprising first layer 53, cell 30, and second layer 55 and contacts the second layer 55. Both surfaces are joined together with a releasable adhesive or a thermo-mechanical bond allowing removal of the active agent delivery system 58 from the mitt. The buffing substrate 56 is a selectively apertured composite material substrate, consisting of three or more layers of different substrates or more joined together by a thermo-mechanical bond. These layers are formed by non-woven, external layers and a filling substrate, however, different materials can be used. The buffing substrate 56 is stretchable to allow for proper mitt fit, hydrophobic to prevent excess polishing agent from being removed off shoe's surface, strong enough for durability during buffing, soft and with surface fibers small enough to provide gloss gain when buffing the surface to be treated.

A plastic film 50 is adhesively or thermo-mechanically sealed against the substrate 56 to form the mitt's palm side. The film 50 is activated to allow for increased stretch and grip during use. The film 50 can also be a breathable film to allow heat and moisture to be removed from user's skin.

A selectively apertured composite material non-woven mesh or an activated non-woven film 52 is then bonded to the plastic film 50 forming the mitt's core pocket. Non-woven mesh is selected to allow for a stretchable, proper fit that is soft, of sufficient strength to ensure proper resistance during the cleaning and buffing processes and breathable to allow heat and moisture to be removed from user's hand while the device is being used.

EXAMPLE 2

Another example of an applicator made in accordance with the present invention is a rubber, vinyl, and plastic protectant mitt provided as a flexible structure for distributing cleaning, protecting, and shining formulations onto a target surface. Such an applicator may include a first fluid-containing reservoir having a predetermined amount, such as in the range from about 12 cc's to about 25 cc's of a protectant product. A protectant product is defined for the purposes of this application as a formulation that prevents drying, cracking, fading and/or discoloration caused by at least one or a combination of UV radiation, high temperature, ozone, dust and dirt. The front panel 24 may be comprised of a synthetic woven, synthetic knit, non-woven, apertured film, macroscopically expanded three-dimensional formed film, absorbent or fibrous absorbent material, foam, or laminates and/or combinations thereof. The non-wovens may be made by, but not limited to, one of the following methods: spunlace, spunbond, meltblow, carded, air-laid, and hydroentangled. One such material sufficient in durability and strength to provide a cleaning surface is a spunbond polypropylene non-woven such as from BBA Non-woven of Simpsonville, S.C. Other structures such as hydroentangled materials comprising cellulose, rayon and polyester may also be used. One such set of materials are made by Dexter Corporation of Windsor Locks, Conn. and sold under the trade name Hydraspun®. One skilled in the art will understand that a wide range of materials can be used as long as the material of interest provides the required durability to complete the cleaning task.

A reservoir and distribution channel may also be provided for the reservoir 30 such as described above. In such a protectant mitt, the reservoir can be located between a layer 37 of tissue or other absorbent material and a second layer of tissue 17 or other absorbent or located between a layer 37 of tissue or other absorbent material and a barrier layer 25, where the absorbent wicking layer(s) would assist in spreading the fluid throughout the front panel 24 while the barrier layer keeps the fluid from contacting the user. The barrier layer can be textured by any means known in the art, including but not limited to, embossing, ring-rolling, and incremental staining, and may also be rendered extensible. The barrier layer can be combined with another "softness enhancing" material that provides additional comfort, softness and tactile feel to the user's hand on the front inner surface 32. Such materials can include, but are not limited to, fibrous (natural, synthetic, or combination thereof) or foamed materials.

On the back side of the mitt, a substantially absorbent material might preferably be utilized to provide a distinct surface for removing and absorbing residual product and dirt left on the plastic, vinyl, or rubber after cleaning with the front panel 24 of the mitt. The mitts can have a barrier film 27 on the back inner surface 34. As described above for barrier layer 25, this material can also be textured by any method known in the art and/or rendered extensible.

The mitts can be used for polishing or cleaning surfaces including but not limited to, vinyl and other plastic car interior surfaces (i.e. dashboards, door panels, trim, consoles, plastic seats, etc.), and vinyl and other plastic car exterior surfaces (i.e. bumpers, trim, vinyl tops, moldings, etc.), rubber automobile tires, as well as, other vinyl and plastic surfaces such as indoor and outdoor furniture, luggage, and the like. As described above, the mitts are ideally suited for cleaning curved or other surfaces with jagged edges or tough to reach areas and can be stored individually, or placed and stacked in containers, folded or unfolded. The combination of easy storage and ability to polish tough to reach areas such as car dashboards, consoles, and trim, makes them ideal for use.

The foregoing examples and descriptions of the preferred embodiments of the invention have been presented for purposes of illustration and description only. They are not intended to be exhaustive or to limit the invention to the precise forms disclosed, and modifications and variations are possible and contemplated in light of the above teachings. While a number of preferred and alternate embodiments, systems, configurations, methods, and potential applications have been described, it should be understood that many variations and alternatives could be utilized without departing from the scope of the invention.

Thus, it should be understood that the embodiments and examples have been chosen and described in order to best illustrate the principles of the invention and its practical applications to thereby enable one of ordinary skill in the art to best utilize the invention in various embodiments and with various modifications as are suited for particular uses contemplated. Accordingly, it is intended that such modifications fall within the scope of the invention as defined by the claims appended hereto.

What is claimed is:

1. A semi-enclosed applicator for distributing a substance onto a target surface, said applicator comprising:

(a) a first layer having a first internal surface and a first external surface;

(b) a second layer having a second internal surface and a second external surface, said second internal surface facing said first internal surface of said first layer, wherein said first and second layers form an internal cavity therebetween;

(c) a reservoir positioned between said first and second layers, wherein said reservoir is dispensible through said first layer, said reservoir having a predetermined exit location;

(d) a third layer facing said second external surface of said second layer; and, (e) wherein said first and second layers and said reservoir are removably attached to said third layer.

2. The applicator of claim 1, further comprising a fourth layer facing and attached to said third layer forming a semi-enclosed cavity therebetween.

3. The applicator of claim 1, further comprising a substantially fluid impervious barrier within said internal cavity located internally of said reservoir.

4. The applicator of claim 1, wherein said reservoir is rupturable.

5. The applicator of claim 1, wherein said reservoir is a flexible reservoir.

6. The applicator of claim 5, wherein said reservoir is a flexible film reservoir.

7. The applicator of claim 4, wherein said reservoir is rupturable at a frangible seal.

8. The applicator of claim 7, wherein said flexible film reservoir is folded proximate to said frangible seal.

9. The applicator of claim 1, wherein said first layer is a substantially non-absorbent material.

10. The applicator of claim 1, wherein said third layer is a substantially absorbent material.

11. The applicator of claim 1, further comprising a friction enhancing element located at least partially within said internal cavity during use.

12. The applicator of claim 1, wherein said structure comprises at least one foldable portion located adjacent said reservoir.

13. A method for making the applicator of claim 1 comprising the steps of:

(a) providing a first web corresponding to one of the first and second layers;

(b) providing a second web corresponding to the other side of said first and second layers;

(c) providing a third web corresponding to the side of said second layer opposite said first layer;

(d) placing a fluid containing reservoir in a predetermined location in relation to said first and second webs;

(e) securing said reservoir relative to said first and second webs;

(f) attaching removably, the result of step (e) to said third web; and, (g) cutting said applicator in a desired outline shape from the balance of the respective webs to define an applicator therefore.

14. The applicator of claim 1, wherein said reservoir further comprises a distribution head, wherein said distribution head distributes said substance onto said target surface from said reservoir.

15. The applicator of claim 14, further comprising a channel located proximate to said distribution head and said reservoir, wherein said channel provides a conduit for said substance between said reservoir and said distribution head.

* * * * *